US007322062B1

(12) United States Patent
Matthews

(10) Patent No.: US 7,322,062 B1
(45) Date of Patent: Jan. 29, 2008

(54) HEALTH APPARATUS

(75) Inventor: Yolan Matthews, Las Vegas, NV (US)

(73) Assignee: Yolande Mathews, LV, NV (US)

( * ) Notice: Subject to any disclaimer, the term of this patent is extended or adjusted under 35 U.S.C. 154(b) by 236 days.

(21) Appl. No.: 11/247,851

(22) Filed: Oct. 12, 2005

(51) Int. Cl.
*A47G 9/10* (2006.01)

(52) U.S. Cl. ..... 5/636; 5/655

(58) Field of Classification Search ..... 5/636–639, 5/643, 645, 655
See application file for complete search history.

(56) References Cited

U.S. PATENT DOCUMENTS 5,088,141 A * 2/1992 Meyer et al. ..... 5/636
6,029,295 A * 2/2000 Larmour et al. ..... 5/636
6,052,849 A * 4/2000 Dixon et al. ..... 5/643
6,052,850 A * 4/2000 Salido et al. ..... 5/644
6,412,128 B1 7/2002 Matthews
6,651,282 B1 11/2003 Skoug et al.
6,748,615 B1 * 6/2004 Tiedemann ..... 5/640
6,763,539 B1 7/2004 Bartley et al.
6,857,150 B2 * 2/2005 Matthews Brown et al. ... 5/655
6,931,682 B2 * 8/2005 Kruger, Jr. ..... 5/645
6,957,462 B1 * 10/2005 Wilcox ..... 5/636
2006/0016011 A1 * 1/2006 Berg ..... 5/636

* cited by examiner

*Primary Examiner*—Michael Trettel

(57) ABSTRACT

A health apparatus for use by infants and toddlers, and particularly infants. The health apparatus is a pillow that protects an infant's head from developing a "flat spot," which frequently occurs in infants from lying on a flat surface in one position for too long a period of time. The pillow is contoured to "fit form" an infant's head. In the middle of the pillow is located an amount of satin, which can help protect an infant's head from losing hair, which also frequently happens to infants.

2 Claims, 2 Drawing Sheets

HEALTH APPARATUS

I. BACKGROUND OF THE INVENTION

The present invention is that of a new and improved health apparatus for use by infants and toddlers, and particularly infants.

II. DESCRIPTION OF THE PRIOR ART

U.S. Pat. No. 6,763,539 B1, issued to Bartley et al., discloses a pillow comprising a pillow body comprising a medial region and two opposing arms with ends extending from the medial region to define an inner well region.

U.S. Pat. No. 6,651,282 B1, issued to Skoug et al., discloses a flexible, crescent shaped pillow to assist mothers to maintain an anatomically correct alignment between a mouth and a nipple while breast feeding.

U.S. Pat. No. 6,412,128 B1, issued to Matthews, discloses a support pillow that comprises a cushion body having a medial region and two opposing arms that define an outer perimeter and a generally open well.

III. SUMMARY OF THE INVENTION

The present invention is that of a new and improved health apparatus for use by infants and toddlers, and particularly infants. The health apparatus is a pillow that protects an infant's head from developing a "flat spot," which frequently occurs in infants from lying on a flat surface in one position for too long a period of time. The pillow is contoured to "fit form" an infant's head. In the middle of the pillow is located an amount of satin, which can help protect an infant's head from losing hair, which also frequently happens to infants.

There has thus been outlined, rather broadly, the more important features of a health apparatus for use by infants and toddlers in order that the detailed description thereof that follows may be better understood and in order that the present contribution to the art may be better appreciated. There are, of course, additional features of the health apparatus for use by infants and toddlers that will be described hereinafter and which will form the subject matter of the claims appended hereto.

In this respect, before explaining at least one embodiment of the health apparatus for use by infants and toddlers in detail, it is to be understood that the health apparatus for use by infants and toddlers is not limited in its application to the details of construction and to the arrangements of the components set forth in the following description or illustrated in the drawings. The health apparatus for use by infants and toddlers is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present health apparatus for use by infants and toddlers. It is important, therefore, that the claims be regarded as including such equivalent constructions insofar as they do not depart from the spirit and scope of the present invention.

It is therefore an object of the present invention to provide a health apparatus for use by infants and toddlers which has all of the advantages of the prior art and none of the disadvantages.

It is another object of the present invention to provide a health apparatus for use by infants and toddlers which may be easily and efficiently manufactured and marketed.

It is another object of the present invention to provide a health apparatus for use by infants and toddlers which is of durable and reliable construction.

It is yet another object of the present invention to provide a health apparatus for use by infants and toddlers which is economically affordable and available for relevant market segments of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
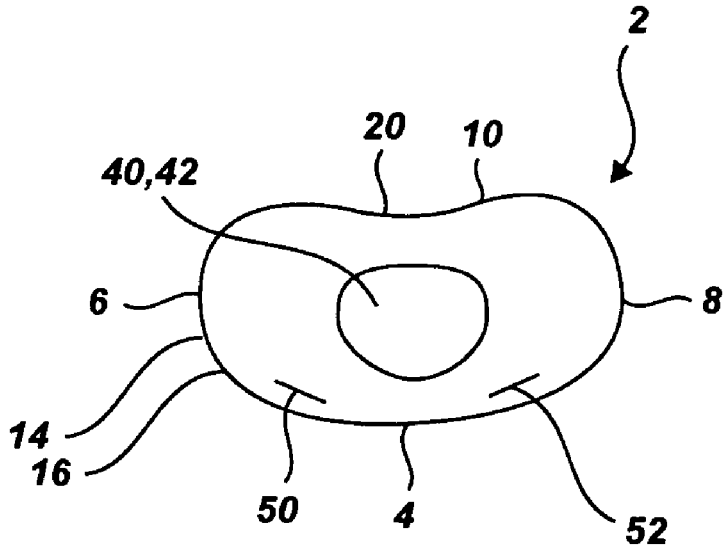
FIG. 1 shows a top view of the preferred embodiment of the health apparatus.
Figure 2:
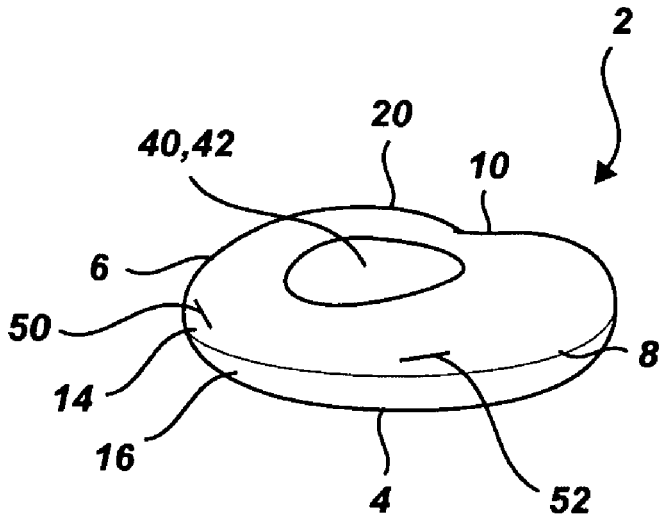
FIG. 2 shows a perspective view of the preferred embodiment of the health apparatus.

FIG. 1 shows a top view of the health apparatus 2, while FIG. 2 shows a perspective view of the health apparatus 2. Health apparatus 2 is designed to be a modified pillow that is used for both infants and toddlers, but particularly for infants in the first four to six months of their life.

One of the health concerns that surrounds new infants is due to the fact that their skulls are not fully formed. Until the infant is approximately one year old, an infant's skull is not fused together, which allows for accommodation of growth. Infant's heads are soft, flexible and fragile for their first year as the skull enlarges to accommodate the growing brain. However, during this time, a baby's skull can become misshapen by external pressure or if the bones fuse too early.

Frequently, one of the reasons that a "flat spot" develops on an infant's head is because the infant is lying flat on its back almost all of the time. When this occurs, a "flat spot" may develop on the back of its head, with this "flat spot" occasionally creating medical problems that may need immediate medical correction and/or surgery to properly address. The present invention is a pillow that addresses this problem by severely reducing pressure on a particular area of an infant's head and evenly redistributes weight in such a manner that the possibility of getting a "flat spot" are greatly reduced or eliminated.

Safety apparatus 2 comes in a few different embodiments. In FIGS. 1 and 2, safety apparatus 2 is a pillow 4 that is kidney-shaped. Pillow 4 has two ends, a first end 6 and a second end 8, and two sides, a top side 10 and a bottom side 12.

The pillow 4 itself has an outer boundary area 14 that is filled with a volume of padding 16. The outer boundary area 14 has the rough shape of a doughnut and is annularly shaped. The thickness of the padding 16 within the outer boundary area 14 is greater near the first end 6 and the second 8 of the pillow 4, while the thickness of the padding 16 gradually becomes more thin in the area in between the first end 6 and the second end 8 of the pillow 4. The outer boundary area 14 is thinnest at the area halfway in between the first end 6 and the second end 8 of the pillow at both the top side 10 and the bottom side 12 of the pillow 4.

In addition to being thin in the area between the first end 6 and the second 8 of the pillow, the area near the top side 10 of the pillow 4 is tapered inward slightly. This taper 20 is designed to accommodate the upper part of an infant's head and make the pillow 4 more comfortable.

In a lot of pillows on the market, the area that is "inside" the outer boundary area 14 is merely a hole. However, in the present invention, this "hole" is actually a center 54 that is covered by two thin layers 40 and 42 of satin. These layers 40 and 42 of satin are designed to help support the middle of an infant's head by having slight flexibility, while at the same time, not allowing the entire central area of an infant's head to fall too deep within the pillow. Such a result actually can cause the infant's head to flatten, thereby defeating the purpose of the present invention.

Furthermore, the softness of the satin layers will help to prevent infant hair loss. An infant, especially early on its life, will spend almost all of its time with a head on a flat surface, which can tend to cause hair loss. By placing a very soft and versatile substance on the present invention, this hair loss will be reduced or eliminated.

The pillow 4 also has two slits 50 and 52 that are located near the bottom side 12 of the pillow. These slits 50 and 52 are placed to strategically accommodate any type of seat belt or lap belt that may be part of an infant carrier or car seat carrier. Slits 50 and 52 allow the pillow 4 to be safely attached to a specific point so that it will not slip down or fall down into another location where it is not being used. Each of the slits are connected by a small tunnel 60 underneath the surface of the safety apparatus 2 to allow the seat belt or lap belt to be continuously inserted through the tunnel 60 and effectively grasp the safety apparatus 2 when it is in use.

Figure 3:
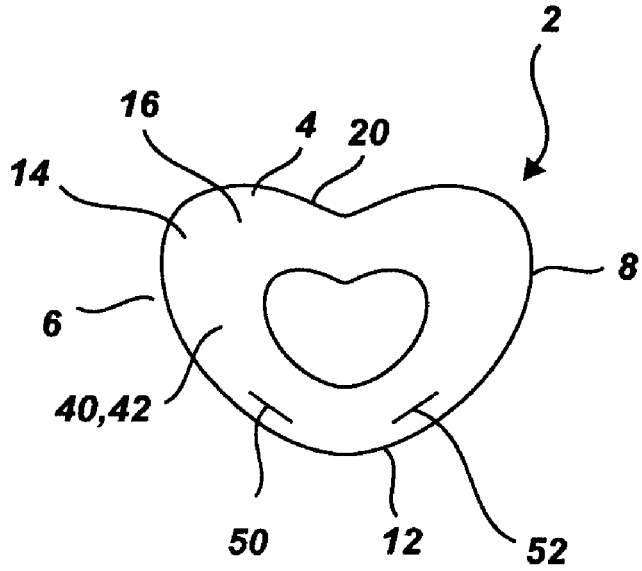
FIG. 3 shows a top view of an alternative embodiment of the health apparatus.
Figure 4:
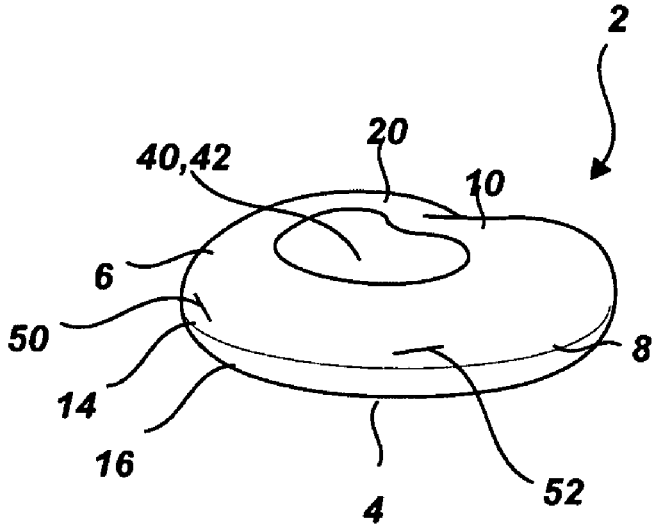
FIG. 4 shows a perspective view of an alternative embodiment of the health apparatus.

FIGS. 3 and 4 show top and perspective views of an alternative embodiment of the safety apparatus 2. In this embodiment, the pillow 4 is shaped like a heart. All the other attributes of the pillow are the same, except that the top side 10 of the pillow 4 is larger than the bottom side 12 because of the asymmetry associated with the heart-shaped pillow 4.

In whichever embodiment, pillow 4 is designed to be fabricated from a fabric that is flame-retardant, hypoallergenic, washable, and a non-bleeding fabric. The pillow 4 could be designed in a wide variety of colors, including but not limited to bright pink, bright blue, navy, tan, or other desirable colors.

What I claim as my invention is:

1. A health apparatus comprising:

(a) a pillow having two ends, a first end and a second end, the pillow also having two sides, a top side and a bottom side, wherein the pillow is kidney-shaped, (b) an outer boundary area on the pillow, the outer boundary area being annularly shaped, the outer boundary area having a thickness, (c) a volume of padding located within the outer boundary area, (d) a slight inward tapering located on the top side of the pillow in between the first end and the second end of the pillow, the slight inward tapering designed to accommodate an infant's head, (e) a plurality of layers of fabric in the center of the pillow, each of the layers of the plurality of layers of fabric in the center of the pillow comprises satin, and wherein the plurality of layers of fabric in the center of the pillow preferably comprises two layers of satin, and (f) a pair of slits comprising a first slit and a second slit, the pair of slits being located near the bottom side of the pillow, the pair of slits forming a small tunnel underneath the surface of the pillow to allow placement of seat belts, lap belts, and the like to be inserted through the pair of slits if the health apparatus is used in an infant carrier or a car seat carrier.

2. A health apparatus comprising:

(a) a pillow having two ends, a first end and a second end, the pillow also having two sides, a top side and a bottom side, wherein the pillow is heart-shaped, (b) an outer boundary area on the pillow, the outer boundary area being annularly shaped, the outer boundary area having a thickness, (c) a volume of padding located within the outer boundary area, (d) a slight inward tapering located on the top side of the pillow in between the first end and the second end of the pillow, the slight inward tapering designed to accommodate an infant's head, (e) a plurality of layers of fabric in the center of the pillow, each of the layers of the plurality of layers of fabric in the center of the pillow comprises satin, and wherein the plurality of layers of fabric in the center of the pillow preferably comprises two layers of satin, and (f) a pair of slits comprising a first slit and a second slit, the pair of slits being located near the bottom side of the pillow, the pair of slits forming a small tunnel underneath the surface of the pillow to allow placement of seat belts, lap belts, and the like to be inserted through the pair of slits if the health apparatus is used in an infant carrier or a car seat carrier.

* * * * *